United States Patent [19]

Chiang

[11] Patent Number: 4,955,261

[45] Date of Patent: Sep. 11, 1990

[54] AUTOMATIC CORKSCREW

[75] Inventor: Yung-Tung Chiang, Chung Ho, Taiwan

[73] Assignee: Chyuan How Enterprise Co., Ltd., Taipei Hsien, Taiwan

[21] Appl. No.: 495,724

[22] Filed: Mar. 19, 1990

[51] Int. Cl.[5] ..... B67B 7/04

[52] U.S. Cl. ..... 81/3.2; 81/3.29; 81/3.45

[58] Field of Search ..... 81/3.2, 3.25, 3.33, 81/3.45, 3.48, 3.29, 3.36

[56] References Cited

U.S. PATENT DOCUMENTS 4,637,283 1/1987 Bertram ..... 81/3.2

FOREIGN PATENT DOCUMENTS 06920 11/1987 European Pat. Off. ..... 81/3.2

*Primary Examiner*—Roscoe V. Parker

*Attorney, Agent, or Firm*—Morton J. Rosenberg; David I. Klein

[57] ABSTRACT

This disclosure relates to an automatic corkscrew and in particular to one which utilizes a motor in association with a ferrule and a drawing tube to rotate a worm into a cork of a bottle and draw it out automatically. Then, the corkscrew may also withdraw the cork automatically by switching a conversion button.

1 Claim, 3 Drawing Sheets

AUTOMATIC CORKSCREW

BACKGROUND OF THE INVENTION

The conventional corkscrew is simply made of a handle and a worn fixedly attached at one end to the handle. However, it requires to exert a rather large force in order to use the corkscrew to pull out a cork from a bottle and sometimes causes hurt to the user when applying excess force thereon.

It is, therefore, an object of the present invention to provide an improved corkscrew which may obviate and mitigate the above-mentioned drawbacks.

SUMMARY OF THE INVENTION

This invention relates to ameliorated corkscrew which drawing corks from bottles.

It is the primary object of the present invention to provide a corkscrew which can automatically draw corks from bottles.

It is another object of the present invention to provide a corkscrew which can autmatically withdraw corks therefrom.

It is still another object of the present invention to provide a corkscrew which is simple in construction.

It is still another object of the present invention to provide a corkscrew which is easy to operate.

It is a further object of the present invention to provide a corkscrew which is efficient to draw corks.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
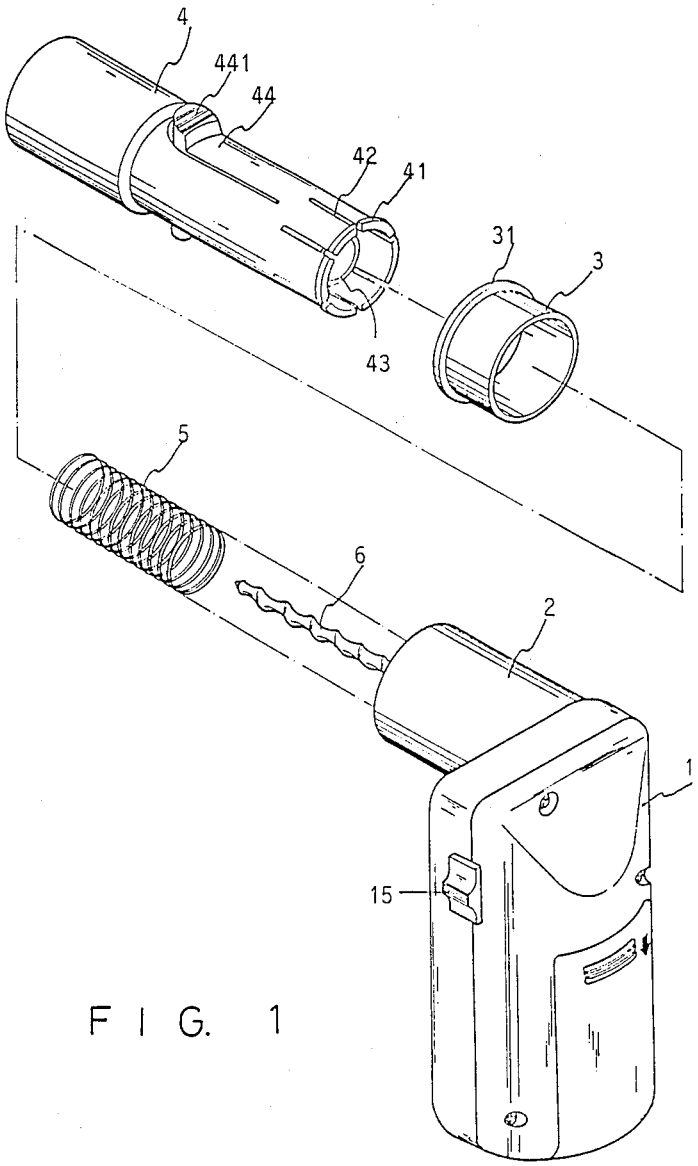
FIG. 1 is a perspective view of an automatic corkscrew according to the present invention.
Figures 2, 3:
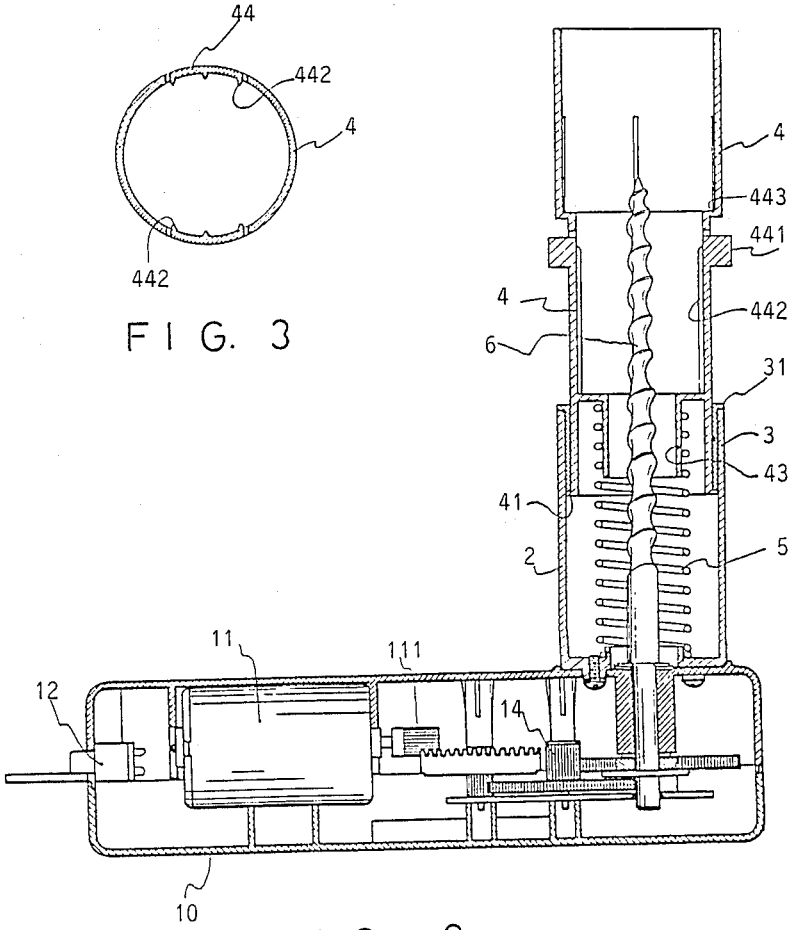
FIG. 2 is a sectional view of an automatic corkscrew according to the present invention.
FIG. 3 is a sectional view of the drawing tube of the automatic corkscrew.
Figure 6:
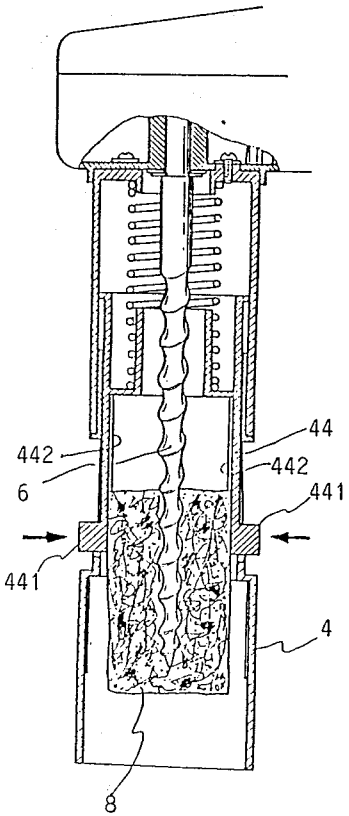
FIG. 6 shows how the automatic corkscrew withdraws the corkscrew therefrom.
Figure 5:
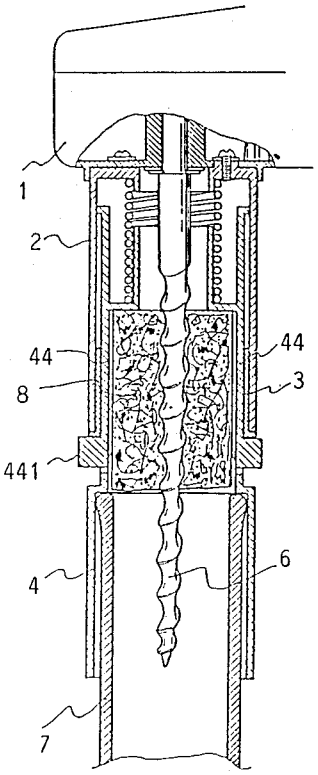
FIG. 5 shows how the automatic corkscrew removes the cork from the bottle.
Figure 4:
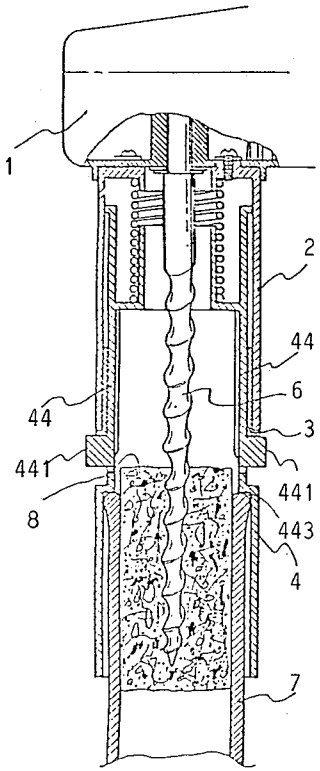
FIG. 4 shows how the automatic corkscrew works.

With reference to the drawings and in particular to FIGS. 1 and 2 thereof, the cork opener according to the present invention comprises a body 1, a tubular member 2, a ferrule 3, a drawing tube 4, a spring 5 and a worm 6. The body 1 includes a chamber 10 in which are mounted a motor 11, a conversion switch 12 electrically connected with the motor 11 having an output gear 111, a room 13 (not shown) for receiving batteries, a gear assembly 15 engaged with the output gear 111 of the motor 11, and a power switch 16 electrically connected with the batteries. The gear assembly 15 is connected with the worm 6 at the output end.

The tubular member 2 is fixedly engaged with the body 1 so that the worm 6 extends therethrough. The ferrule 3 is put into the other end of the tubular member 2 with its flange 31 in contact with the edge thereof. The drawing tube 4 is inserted into the ferrule 3 with the flange 41 of the collect 42 at the inner end in contact with the inner edge thereof. The drawing tube 4 has a central cylindrical portion 43 at the inner end so that the spring 5 is arranged between the lower end of the tubular member 2 and the cylindrical portion 43 of the drawing tube 4. The length of the drawing tube 4 is cut to form two opposite resilient plates 44 on which there is formed a protuberance 441. The inner side of the resilient plate 44 is provided with a plurality of longitudinal projections 442 (see FIG. 3).

In use, first put the drawing tube 4 over the mouth 7 of a bottle with the shoulder 443 resting on the lip 71 of the mouth 7. Then, turn on the power switch 15 so that the worm 6 will rotate into the cork 8 and the tubular member 2 together with the ferrule 3 will be drawn downwards until the flange 31 of the ferrule 3 is blocked by the protuberances 441 of the drawing tube 4. Since the worm 6 is mounted at a fixed position, the cork 8 will be lifted into the drawing tube 4 along the worm 6 thereby removing the cork 8 from the bottle. Thereafter, press the protuberances 441 of the drawing tube 4 inwards so as to engage the longitudinal projections 442 with the cork 8 and turn on the conversion switch 12 to reverse the rotating direction of the worm 6 consequently withdrawing the cork 8 from the drawing tube 4.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An automatic corkscrew comprising:

a body having a motor, a power source connected with the motor, a conversion switch electrically connected with the motor, a gear assembly engaged with an output shaft of the motor, a power switch for controlling the power source and a worm fixed connected with an output end of the gear assembly;

a tubular member fixedly engaged at one end with said body;

a ferrule put into the other end of said tubular member with flanges in contact with the edge thereof;

a drawing tube inserted into said ferrule and having collets at the inner end, said collet having a flange in contact with inner edge of said ferrule, and a central cylindrical portion at the inner end, said drawing tube being cut along the length to form resilient plates provided with a protuberance and a plurality of longitudinal projections at the inner sides; and a spring disposed between said tubular member and the central cylindrical portion of said drawing tube.

* * * * *